US005615719A

United States Patent [19]

Balon

[11] Patent Number: 5,615,719

[45] Date of Patent: Apr. 1, 1997

[54] HOCKEY STICK CURVING APPARATUS

[76] Inventor: Richard L. Balon, 12303 - 141 Street, Edmonton, Alberta, Canada, T5L 2G3

[21] Appl. No.: 678,456

[22] Filed: Jul. 9, 1996

[51] Int. Cl.[6] ..... B27H 1/00

[52] U.S. Cl. ..... 144/269; 144/380; 144/381; 269/152; 269/296; 156/443

[58] Field of Search ..... 144/254, 255, 144/269, 270, 329, 361, 364, 380, 381; 156/443; 269/152, 296

[56] References Cited

U.S. PATENT DOCUMENTS

| | | | |
|---|---|---|---|
| 1,376,678 | 5/1921 | Cua | 144/269 |
| 2,773,303 | 12/1956 | Tirone | 269/152 |
| 2,848,785 | 8/1958 | Bachli et al. | 269/296 |
| 2,982,321 | 5/1961 | Hancock | 144/381 |
| 2,991,669 | 7/1961 | Stock | 269/152 |
| 3,003,204 | 10/1961 | Bryant | 144/381 |
| 4,615,073 | 10/1986 | Hask | 269/152 |
| 4,691,907 | 9/1987 | Yang | 269/152 |
| 4,741,371 | 5/1988 | Lord | 144/269 |
| 4,858,665 | 8/1989 | Miller et al. | 144/380 |
| 5,203,948 | 4/1993 | Suska | 144/269 |
| 5,297,602 | 3/1994 | Nobbe | 144/270 |

FOREIGN PATENT DOCUMENTS

| | | | |
|---|---|---|---|
| 3033802 | 8/1982 | Germany | 144/381 |

*Primary Examiner*—W. Donald Bray
*Attorney, Agent, or Firm*—Anthony R. Lambert

[57] ABSTRACT

A hockey stick curving apparatus which includes a rail having a first end, a second end, and an exterior surface. A movable pressure member support frame is mounted to the exterior surface of the rail and movable between the first end and the second end. A pressure member is mounted to the pressure member support frame and movable in a first direction toward the rail and in a second direction away from the rail. A pair of supports are secured to the rail in spaced relation. One of the pair of supports is on one side of the pressure member support frame and the other one of the pair of supports is on an other side of the pressure member support frame.

11 Claims, 5 Drawing Sheets

HOCKEY STICK CURVING APPARATUS

FIELD OF THE INVENTION

The present invention relates to an apparatus for curving hockey sticks and, in particular, an apparatus that has a wide range of adjustment to suit diverse needs of all players on a team.

BACKGROUND OF THE INVENTION

U.S. Pat. No. 4,741,371 which issued to Lord in 1988 discloses an invention entitled "Jig for Bending a Hockey Stick Blade". The apparatus disclosed is especially adapted to perform the task of placing a curve on hockey stick. Prior to the development of the Lord apparatus the task of placing a curve on a hockey stick was performed manually. The Lord apparatus consists of a rigid plate on which are mounted two parallel longitudinal guide tracks. Support members are mounted to the plate at either end of the guide tracks. A pressure member is provided which is mounted to and movable along the guide tracks. In order to use the Lord apparatus, a blade of a hockey stick is placed on the support members. The pressure member is then moved along the guide tracks to a selected pressure point on the hockey stick blade. The pressure member is then used to apply pressure to create a curve.

The Lord apparatus permits a trainer for a hockey team to control the depth of the curve by adjusting the amount of pressure exerted by the pressure member. The Lord apparatus also permits the trainer to position the curve at either the tip, heel or mid-point of the blade by sliding the pressure member along the guide rails. Unfortunately, the Lord apparatus has inherent limitations which render it unsuitable for making some types of curves.

SUMMARY OF THE INVENTION

What is required is an alternative configuration for a hockey stick curving apparatus.

According to the present invention there is provided a hockey stick curving apparatus which includes a rail having a first end, a second end, and an exterior surface. A movable pressure member support frame is mounted to the exterior surface of the rail and movable between the first end and the second end. Means is provided for locking the pressure member support frame to the rail in a selected position. A pressure member is mounted to the pressure member support frame and movable in a first direction toward the rail and in a second direction away from the rail. A pair of supports are secured to the rail in spaced relation. One of the pair of supports is on one side of the pressure member support frame and the other one of the pair of supports is on an other side of the pressure member support frame.

The hockey stick curving apparatus, as described above, is an alternative configuration that is capable of performing all of the functions of the Lord apparatus. As will hereinafter be further explained, with the addition of some further features this alternative configuration can perform functions in the art of curving hockey sticks that the Lord apparatus is incapable of performing.

Although beneficial results may be obtained through the use of the hockey stick curving apparatus, as described above, there is a wide variation among hockey players in the radius and location of curve desired. The stick can be curved at any point between the heel and the toe. There are, however, three primary locations for a curve; adjacent a heel of the stick, adjacent a toe of the stick or at a mid-point between the heel and the toe. The radius of the curve has two aspects; its length and its depth. Even more beneficial results may, therefore, be obtained when at least one of said supports is movable along the rail and means is provided to lock the support to the rail in a selected position. Having at least one of the supports movable enables the spacing between the supports to be adjusted, thereby adjusting the length of the curve. The depth of the curve is determined by the pressure member. By altering the depth of penetration of the penetration of the pressure member, the spacing of the supports or both; the characteristics of the curve can be dramatically changed. The location of the curve at the toe, heel or midpoint of the stick is controlled by the positioning of the hockey stick relative to the supports.

Although beneficial results may be obtained through the use of the hockey stick curving apparatus, as described above, many hockey players prefer to have a torsional curve at the tip of the blade of their hockey stick. Even more beneficial results may, therefore, be obtained when one of said supports has both a rail engaging portion movably mounted to the rail and a pivoting portion pivotally mounted to the rail engaging portion. The pivoting portion of the support is pivotally movable relative to the rail. This enables a torsional curve to be placed on a portion of the blade.

Although beneficial results may be obtained through the use of the hockey stick curving apparatus, as described above, a trainer serving the needs of a team of players needs to be able to rapidly prepare the blades of hockey sticks to meet the needs of individual players on a team. Even more beneficial results may, therefore, be obtained when the rail has indicia to indicate the axial positioning of the pressure member support frame and the supports along the rail; the pressure support member has indicia to indicate the positioning of the pressure member relative to the rail and the depth of penetration; and the rail engaging portion of the angularly adjustable support has indicia to indicate the angular positioning of the pivoting portion of the support relative to the rail. With indicia, as described, a trainer having once prepared a blade of a hockey stick for an individual player, need only set the pressure member support frame, the pressure member and the pivoting portion of the angularly adjustable support to the position that gave a successful result on the last occasion.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
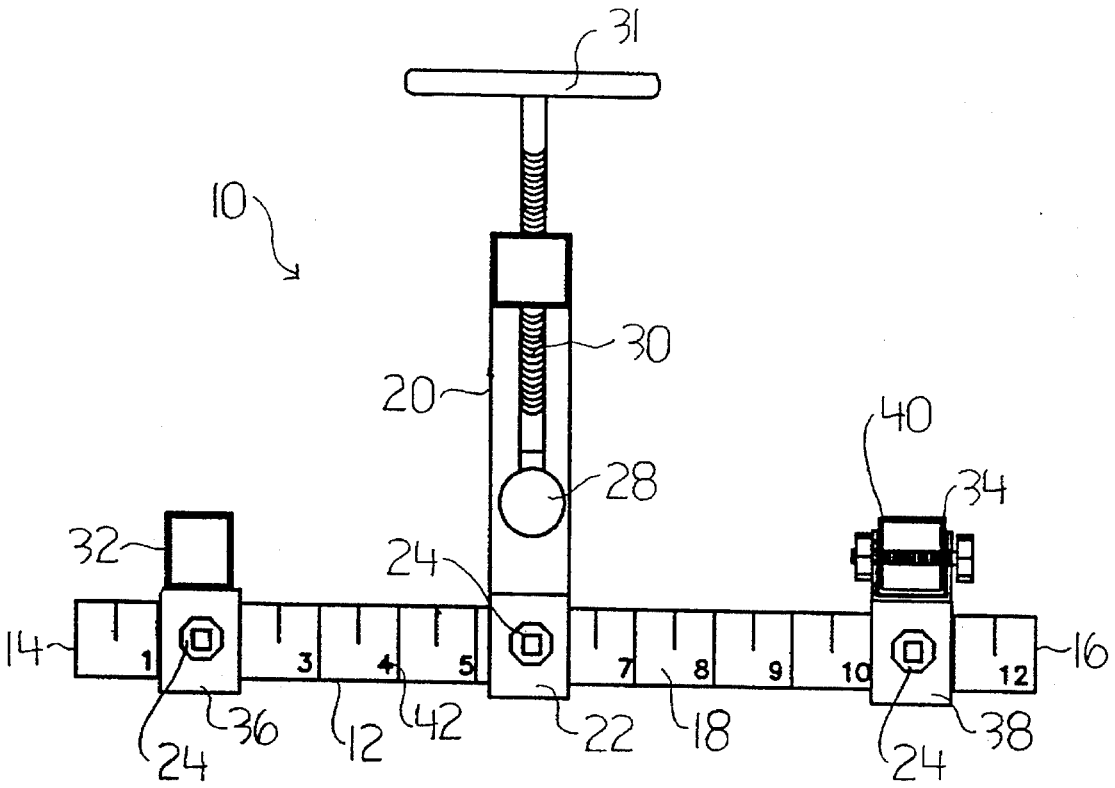
FIG. 1 is a front elevation view of a hockey stick curving apparatus constructed in accordance with the teachings of the present invention.

The preferred embodiment, a hockey stick curving apparatus 10 generally identified by reference numeral 10, will now be described with reference to FIGS. 1 through 14.

Figure 2:
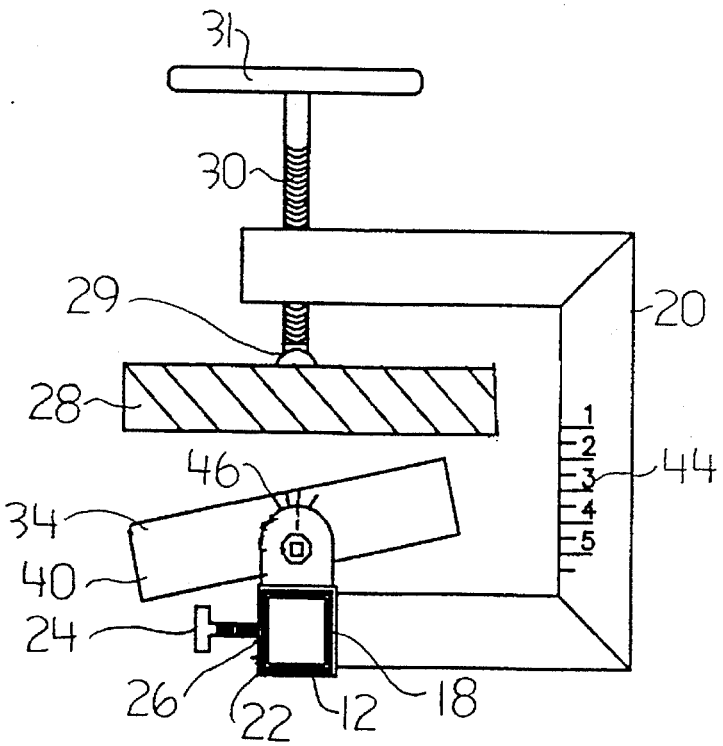
FIG. 2 is a side elevation view of the hockey stick curving apparatus illustrated in FIG. 1.
Figure 3:
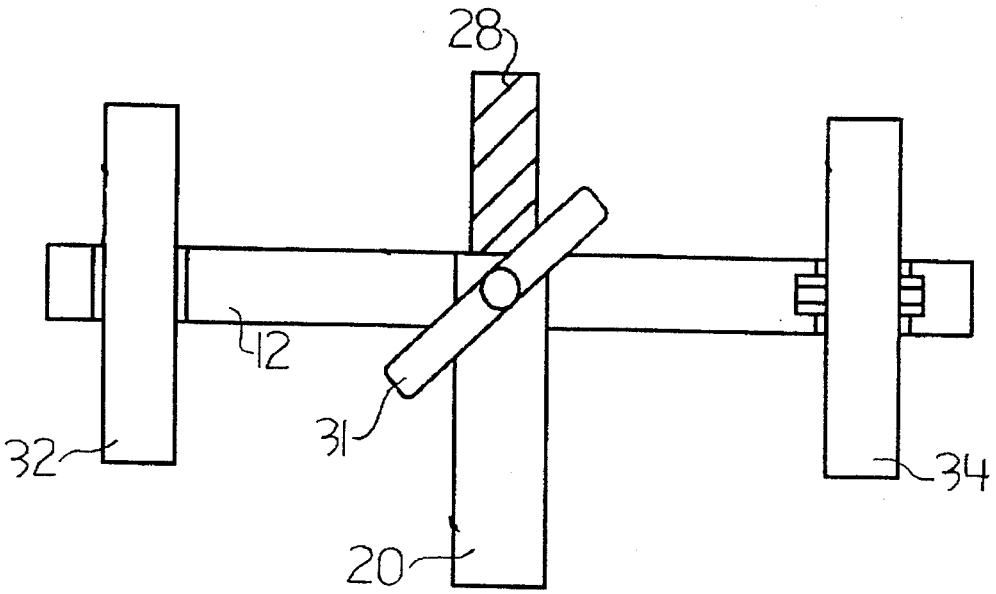
FIG. 3 is a top plan view of the hockey stick curving apparatus illustrated in FIG. 1.

Referring to FIG. 1, hockey stick curving apparatus 10 includes a rail 12 having a first end 14, a second end 16, and an exterior surface 18. Referring to FIGS. 2 and 3, a generally "C" shaped movable pressure member support frame 20 is mounted to a sleeve 22 that slides along exterior surface 18 of rail 12 between first end 14 and second end 16. A locking screw 24 extends through a threaded aperture 26 in sleeve 22 and bears against exterior surface 18 of rail 12 to lock pressure member support frame 20 to rail 12 in a selected position. An elongate pressure member 28 is positioned transversely across rail 12 and mounted to pressure member support frame 20 by means of a long mounting screw 30. By turning screw 30 by means of handle 31 in a selected direction pressure member 28 is movable in either a first direction toward rail 12 or in a second direction away from rail 12. Referring to FIG. 1, a pair of supports 32 and 34 are provided. Each of supports 32 and 34 are secured to sleeves 36 and 38, respectively, that slide along exterior surface 18 of rail 12. Supports 32 and 34 are positioned in spaced relation. Support 32 is positioned on one side of pressure member support frame 20 and support 34 is positioned on the other side of pressure member support frame 20. As described in relation to sleeve 22 of pressure member support frame 20, supports 32 and 34 each have a locking screw 24 extending through a threaded aperture 26 in sleeves 36 and 38, respectively. Locking screws 24 bear against exterior surface 18 of rail 12 to lock supports 32 and 34 to rail 12 in a selected position. Referring to FIG. 2, support 34 is angularly adjustable. Support 34 has a pivoting portion 40 pivotally mounted to rail engaging sleeve 38. Pivoting portion 40 is pivotally movable relative to rail 12. Referring to FIG. 1, exterior surface 18 of rail 12 has indicia 42 to indicate the axial positioning of pressure member support frame 20, and supports 32 and 34 along rail 12. Referring to FIG. 2, pressure member support member 20 has indicia 44 to indicate the positioning of pressure member 28 relative to rail 12, ie. the depth of penetration of pressure member 28. Rail engaging sleeve 38 of angularly adjustable support 34 has indicia 46 to indicate the angular positioning of pivoting portion 40 of support 34 relative to rail 12.

Figure 4:
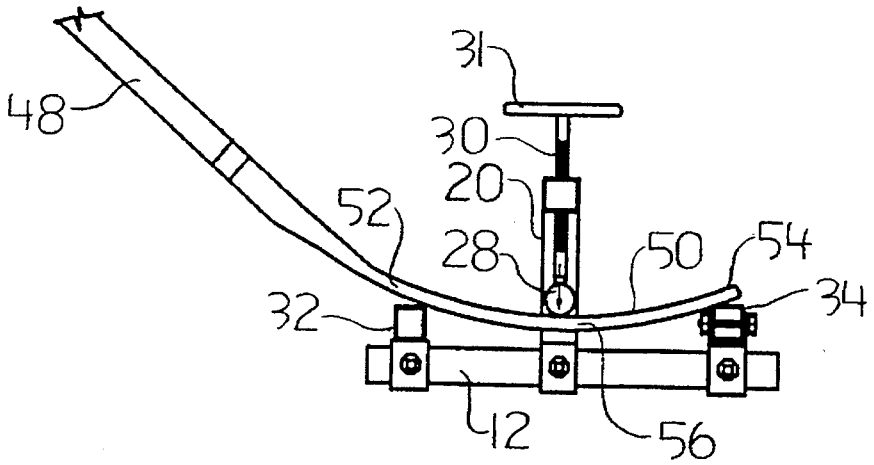
FIG. 4 is a front elevation view of the hockey stick curving apparatus illustrated in FIG. 1, with the pressure member in a position to engage a mid-point on a hockey stick and the supports positioned far apart.
Figure 5:
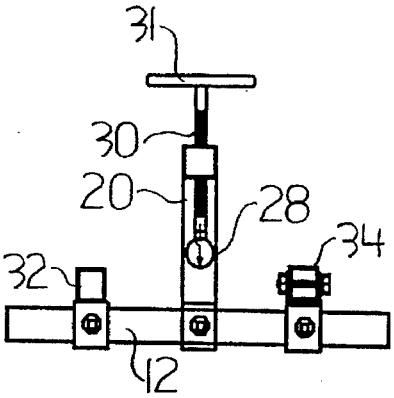
FIG. 5 is a front elevation view of the hockey stick curving apparatus illustrated in FIG. 1, with the pressure member in a position to engage a mid-point on a hockey stick and the supports positioned in an intermediate position.
Figure 6:
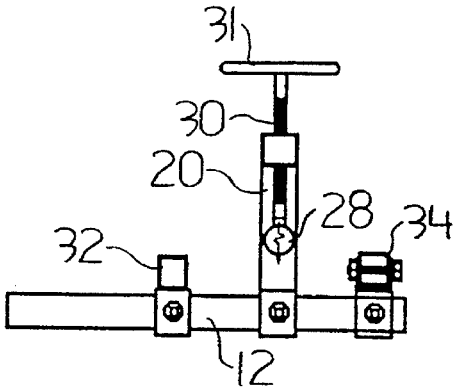
FIG. 6 is a front elevation view of the hockey stick curving apparatus illustrated in FIG. 1, with the pressure member in a position to engage a mid-point on a hockey stick and the supports positioned close together.
Figure 7:
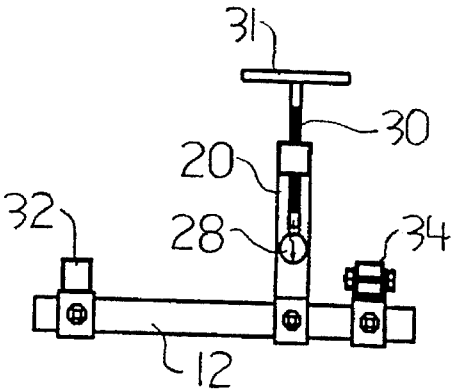
FIG. 7 is a front elevation view of the hockey stick curving apparatus illustrated in FIG. 1, with the pressure member in a position to engage a toe of a hockey stick and the supports positioned far apart.
Figure 8:
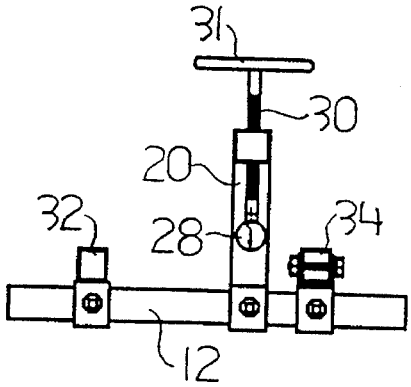
FIG. 8 is a front elevation view of the hockey stick curving apparatus illustrated in FIG. 1, with the pressure member in a position to engage a toe of a hockey stick and the supports positioned in an intermediate position.
Figure 9:
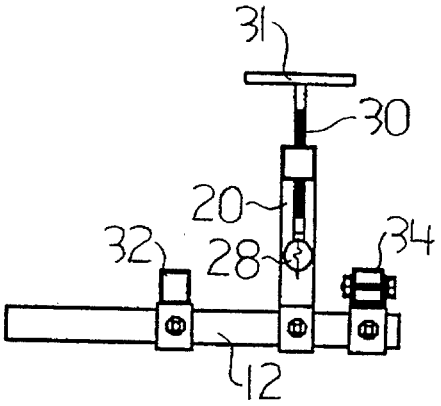
FIG. 9 is a front elevation view of the hockey stick curving apparatus illustrated in FIG. 1, with the pressure member in a position to engage a toe of a hockey stick and the supports positioned close together.
Figure 10:
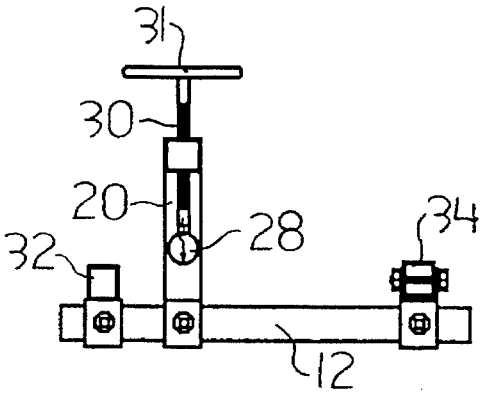
FIG. 10 is a front elevation view of the hockey stick curving apparatus illustrated in FIG. 1, with the pressure member in a position to engage a heel of a hockey stick and the supports positioned far apart.
Figure 11:
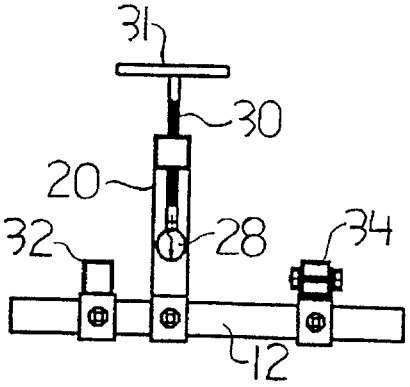
FIG. 11 is a front elevation view of the hockey stick curving apparatus illustrated in FIG. 1, with the pressure member in a position to engage a heel of a hockey stick and the supports positioned in an intermediate position.
Figure 12:
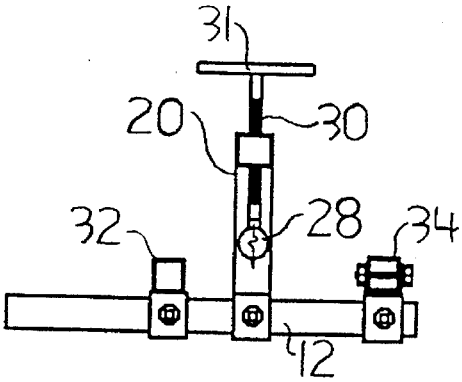
FIG. 12 is a front elevation view of the hockey stick curving apparatus illustrated in FIG. 1, with the pressure member in a position to engage a heel of a hockey stick and the supports positioned close together.
Figure 13:
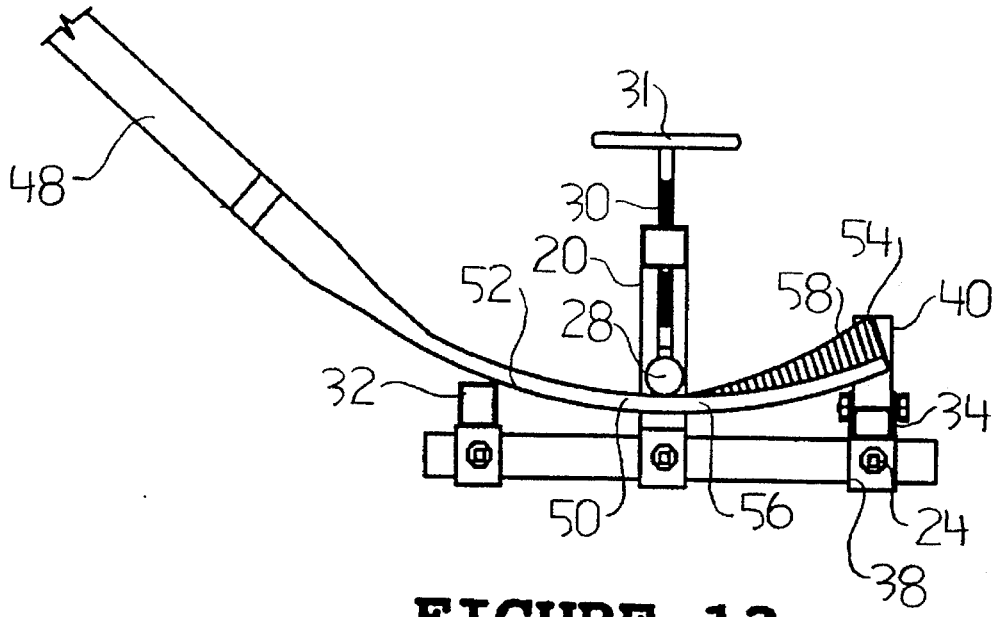
FIG. 13 is a front elevation view of the hockey stick curving apparatus illustrated in FIG. 1, with the pressure member in a position to engage a mid-point of a blade of a hockey stick and the angularly adjustable support positioned to place a torsional curve at the bottom of the tip of the blade.
Figure 14:
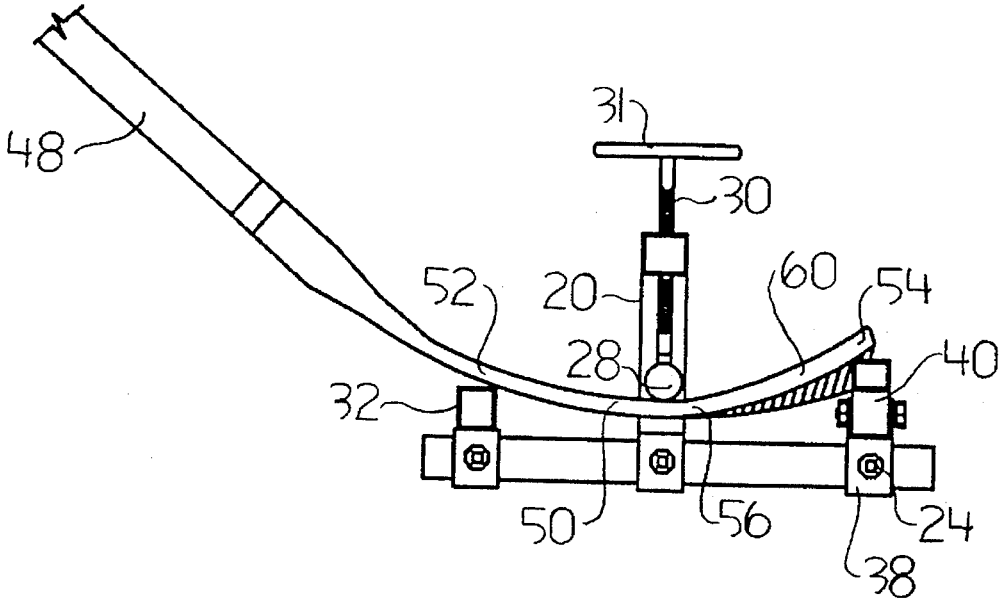
FIG. 14 is a front elevation view of the hockey stick curving apparatus illustrated in FIG. 1, with the pressure member in a position to engage a mid-point of a blade of a hockey stick and the angularly adjustable support positioned to place a torsional curve at the top of the tip of the blade.

The use and operation of hockey stick curving apparatus 10 will now be described with reference to FIGS. 1 through 14. FIGS. 4 through 14, illustrate various configurations that hockey stick curving apparatus can assume in order to curve a hockey stick. Such illustrations serve to show the versatility of the apparatus. In FIGS. 4, 13, and 14, a hockey stick, generally indicated by reference numeral 48 is illustrated. Hockey stick 48 has a blade 50. Blade 50 has a heel 52, a toe 54 and a mid-point 56. FIG. 4 illustrates pressure member 28 in a position to engage mid-point 56 on blade 50 and supports 32 and 34 positioned far apart. FIG. 5 also illustrates pressure member 28 in the same position as in FIG. 4, but with supports 32 and 34 positioned in more of an intermediate position. FIG. 6 also illustrates pressure member 28 in the same position as in FIG. 4, but with supports 32 and 34 positioned close together adjacent to toe 54 of blade 50. FIG. 7 illustrates pressure member 28 in a forward position where it can engage a toe of a hockey stick (not shown) with supports 32 and 34 positioned far apart. FIG. 8 also illustrates pressure member in a forward position, but with supports 32 and 34 positioned in a more intermediate position. FIG. 9 also illustrates pressure member in a forward position, but with supports positioned close together. FIG. 10 illustrates pressure member 28 in a rearward position to engage a heel of a hockey stick (not shown), with supports 32 and 34 positioned far apart. FIG. 11 also illustrates pressure member 28 in a rearward position, but with supports positioned in an intermediate position. FIG. 12 also illustrates pressure member 28 in a rearward position, but with supports 32 and 34 positioned close together. FIG. 13 illustrates pressure member 28 in a position to engage mid-point 56 of blade 50 of hockey stick 48. Angularly adjustable support 34 is positioned to place a torsional curve at a bottom 58 of toe 54 of blade 50. FIG. 14 also illustrates pressure member 28 in a position to engage mid-point 56 of blade 50 of hockey stick 48. Angularly adjustable support 34 is positioned to place a torsional curve at a top 60 of toe 54 of blade 50. Referring to FIG. 2, it is preferred that pressure member 28 be mounted on a ball 29 so as to be capable of omni-directional movement, ie. both up and down, and from side to side. This enables the pressure member to be placed at an angle in relation to both a vertical plane and a horizontal plane when making the torsional curve illustrated in FIGS. 13 and 14.

The steps one follows in curving blade 50 of hockey stick 48 with hockey stick curving apparatus 10 is as follows. Firstly, supports 32 and 34 are moved along rail 12 a desired distance apart with reference to indicia 42. The selected spacing determines the length of the desired curve. Once in position, supports 32 and 34 are locked in position by means of locking screws 24. Secondly, pressure member support frame 20 is moved along rail 12 to a position that approximates the center of the desired curve with reference to indicia 42. Pressure member support frame 20 is locked in position by locking screw 24. Thirdly, heat is applied to hockey stick 48. It is preferred that hockey stick 48 be warmed slowly and evenly. Care must be taken to distribute the heat evenly as heel 52 is generally thicker than toe 54. At no time should hockey stick 48 be to hot to hold in ones hands. There are a variety of household devices that can be used to apply heat, perhaps the safest of which is an air blower style of hair dryer. Fourthly, hockey stick 48 should be placed upon supports 32 and 34. To position a curve at mid-point 56, heel 52 rests upon support 32 and toe 54 rests upon support 34. The curve can be shifted toward heel 52 or toe 54 by altering the position of hockey stick 48 on supports 32 and 34. Fifthly, the depth of the curve is adjusted with reference to indicia 44 by turning handle 31 to cause pressure member 28 to descend in the first direction toward rail 12. Sixthly, the angle of pivoting portion 40 of angularly adjustable support 34 is adjusted with reference to indicia 46.

It should be noted that hockey stick 48 will have a tendency to spring back to some degree when removed from hockey stick curving apparatus 10. For that reason, the adjustments made must take into account the spring back that does occur. Hockey stick 50 is then left in hockey stick curving apparatus 10 at the indicia setting that gave previous beneficial results for the individual player, until hockey stick 50 has completely cooled.

It will be apparent to one skilled in the art the greater range of curves that are possible with hockey stick curving apparatus, as described. It will also be apparent to one skilled in the art that the hockey stick curving apparatus, as described, is equally capable of curving sticks for left handed shots, sticks for right handed shots, and even goalie sticks. It will also be apparent to one skilled in the art the enormous benefits that trainers serving the needs of numerous hockey players will derive from the ability to set hockey stick curving apparatus with reference to the indicia. It will finally be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A hockey stick curving apparatus, comprising:

a rail having a first end, a second end, and an exterior surface;

a movable pressure member support frame mounted to the exterior surface of the rail and movable between the first end and the second end;

means for locking the pressure member support frame to the rail in a selected position;

a pressure member mounted to the pressure member support frame and movable in a first direction toward the rail and in a second direction away from the rail;

a pair of supports secured to the rail in spaced relation, one of the pair of supports being on one side of the pressure member support frame and the other one of the pair of supports being on an other side of the pressure member support frame.

2. The hockey stick curving apparatus as defined in claim 1, wherein at least one of said supports is movable along the rail, means being provided to lock the support to the rail in a selected position.

3. The hockey stick curving apparatus as defined in claim 1, wherein at least one of said supports has both a rail engaging portion movably mounted to the rail and a pivoting portion pivotally mounted to the rail engaging portion, such that the pivoting portion of the support is pivotally movable relative to the rail.

4. The hockey stick curving apparatus as defined in claim 1, wherein the rail has indicia to indicate the axial positioning of the pressure member support frame along the rail.

5. The hockey stick curving apparatus as defined in claim 1, wherein the pressure support member has indicia to indicate the positioning of the pressure member relative to the rail.

6. The hockey stick curving apparatus as defined in claim 3, wherein the rail engaging portion of the support has indicia to indicate the angular positioning of the pivoting portion of the support relative to the rail.

7. A hockey stick curving apparatus, comprising:

a rail having a first end, a second end, and an exterior surface;

a movable pressure member support frame mounted to the exterior surface of the rail and movable between the first end and the second end;

means for locking the pressure member support frame to the rail in a selected position;

a pressure member mounted to the pressure member support frame and movable in a first direction toward the rail and in a second direction away from the rail;

a pair of supports secured to the rail in spaced relation, one of the pair of supports being on one side of the pressure member support frame and the other one of the pair of supports being on an other side of the pressure member support frame;

at least one of said supports is movable along the rail, means being provided to lock the support to the rail in a selected position; and at least one of said supports having both a rail engaging portion movably mounted to the rail and a pivoting portion pivotally mounted to the rail engaging portion, such that the pivoting portion of the support is pivotally movable relative to the rail.

8. The hockey stick curving apparatus as defined in claim 7, wherein the rail has indicia to indicate the axial positioning of the pressure member support frame and the supports along the rail.

9. The hockey stick curving apparatus as defined in claim 7, wherein the pressure support member has indicia to indicate the positioning of the pressure member relative to the rail.

10. The hockey stick curving apparatus as defined in claim 7, wherein the rail engaging portion of the support has indicia to indicate the angular positioning of the pivoting portion of the support relative to the rail.

11. A hockey stick curving apparatus, comprising:

a rail having a first end, a second end, and an exterior surface;

a generally "C" shaped movable pressure member support frame mounted to a sleeve that slides along the exterior surface of the rail between the first end and the second end;

a locking screw extending through a threaded aperture in the sleeve and bearing against the rail to lock the pressure member support frame to the rail in a selected position;

an elongate pressure member positioned transversely across the rail and mounted to the pressure member support frame by means of a mounting screw, such that by turning the screw in a selected direction the pressure member is movable in a first direction toward the rail and in a second direction away from the rail;

a pair of supports, each support being secured to sleeves that slide along the exterior surface of the rail, the supports being positioned in spaced relation with one of the pair of supports being on one side of the pressure member support frame and the other one of the pair of supports being on an other side of the pressure member support frame;

each of said supports having a locking screw extending through a threaded aperture in the sleeve and bearing against the rail to lock the support to the rail in a selected position;

one of said supports being angularly adjustable having a pivoting portion pivotally mounted to the rail engaging sleeve, the pivoting portion being pivotally movable relative to the rail;

the exterior surface of the rail having indicia to indicate the axial positioning of the pressure member support frame and the supports along the rail;

the pressure support member having indicia to indicate the positioning of the pressure member relative to the rail; and the rail engaging sleeve of the angularly adjustable support having indicia to indicate the angular positioning of the pivoting portion of the support relative to the rail.

* * * * *